US009644526B2

(12) United States Patent
Graham et al.

(10) Patent No.: US 9,644,526 B2
(45) Date of Patent: May 9, 2017

(54) VENTING PLUG FOR ENGINE COOLANT FILLING

(71) Applicant: Caterpillar Inc., Peoria, IL (US)

(72) Inventors: Curtis Graham, Peoria, IL (US); Jonathan Eggemeyer, East Peoria, IL (US); Taylor Young, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 79 days.

(21) Appl. No.: 14/665,336

(22) Filed: Mar. 23, 2015

(65) Prior Publication Data

US 2016/0281588 A1 Sep. 29, 2016

(51) Int. Cl.
*F01P 11/02* (2006.01)

(52) U.S. Cl.
CPC ..... *F01P 11/0285* (2013.01); *F01P 11/0209* (2013.01); *F01P 2011/0252* (2013.01)

(58) Field of Classification Search
CPC .... F01P 11/02; F01P 11/0204; F01P 11/0209; F01P 11/0214; F01P 2011/0228; F01P 2011/0233; F01P 2011/0238; F01P 2011/0252; F01P 11/028; F01P 11/085
See application file for complete search history.

(56) References Cited

U.S. PATENT DOCUMENTS

| | | | | |
|---|---|---|---|---|
| 4,241,845 | A | 12/1980 | Daly et al. | |
| 4,776,390 | A | 10/1988 | Crofts | |
| 4,986,502 | A * | 1/1991 | Ceroke | F16J 13/24 251/216 |
| 5,169,015 | A | 12/1992 | Burke | |
| 6,500,038 | B1 * | 12/2002 | Jaeger | B63H 21/32 123/41.08 |
| 2008/0202596 | A1 * | 8/2008 | Kato | F01P 11/028 137/197 |

* cited by examiner

*Primary Examiner* — Jacob Amick
(74) *Attorney, Agent, or Firm* — Baker Hostetler

(57) ABSTRACT

A venting plug assembly for sealing a coolant channel and venting air therefrom is disclosed. The coolant channel defines an open portion to receive the venting plug assembly. The venting plug assembly includes an outer sealing element with an annular portion configured for sealing engagement with the open portion of the coolant channel. The venting assembly further includes an inner sealing element configured for sealing engagement with the annular portion of the outer sealing element. The inner sealing element is configured to move relative to the annular portion of the outer sealing element to allow air to vent from the coolant channel through the outer sealing element.

20 Claims, 8 Drawing Sheets

VENTING PLUG FOR ENGINE COOLANT FILLING

TECHNICAL FIELD

The disclosure generally relates to methods and devices for ensuring the proper refilling of coolant in a coolant system of an engine, and more particularly to methods and devices utilizing a venting plug assembly for sealing coolant channels in an engine and for ensuring the proper refilling of coolant and venting of air in a coolant system of an engine.

BACKGROUND

Internal combustion engines are used to provide a power source for vehicles, generator sets, heavy mechanical equipment, large tractors, on-road vehicles, off-road vehicles, and the like. Some internal combustion engines include heat dissipation systems to promote engine operating efficiency and component life.

Engine cooling systems which flow a coolant through components of the engine, such as, a block of the engine, are well known. The coolant captures heat from the engine and may transfer the heat to ambient air via a radiator in thermal communication with the ambient air. The radiator may include a series of channels through which the coolant is pumped, and airflow induced by a fan cools the channels, and hence the coolant flowing through the channels. The coolant may be pumped through various engine components, such as the engine block, the cylinder head, an engine oil cooler, or the like, to capture heat from the components. The coolant channels are typically present in the various engine components, such as the engine block and cylinder head, to allow the coolant to flow through the various engine components.

When the engine block is manufactured, the coolant channels may be molded in the engine block. For example, sand or green sand may be utilized for producing, in part, the molds. The sand is typically positioned inside or as part of a mold that is used to cast the engine components. These components are subsequently manufactured by pouring molten iron or aluminum into the mold. Once the casting is cooled, the sand is typically removed. For example, sand may be removed through the holes in the engine block, leaving channels that the coolant flows through. The holes may be manufactured for other reasons as well. These holes are then plugged or sealed using freeze plugs, also known as cup plugs. Freeze plugs commonly have a shallow cup with walls that are slightly tapered so that the cup may be press fitted into the hole and held therein by friction.

The coolant used in engines may benefit from periodic flushing and refilling with a new supply or fresh coolant to promote heat transfer characteristics of the coolant. However, in many engine components, such as the cylinder head, air can become trapped during the coolant refilling procedure. The trapped air may be problematic because it causes hot spots and can lead to cracks in the component, which may affect component life. Therefore, venting air from the cooling system may be advantageous during a coolant refilling procedure.

Different strategies have been employed to address the issue of venting air trapped in a coolant system during the coolant refill procedure, including different types of caps and seals. For example, U.S. Pat. No. 5,169,015 ("Burke") describes a radiator cap for closing the filler neck of a radiator fluid reservoir. The radiator cap includes a manually manipulable crown having a central aperture which covers the filler neck and a spring disc also having a central aperture. The cap has a member that extends through the central apertures of the crown and spring disc and an auxillary vacuum seal disposed between the spring and the member to enhance the sealing properties of the radiator cap.

While conventional radiator caps may be useful to some extent, these conventional approaches do not specifically address the difficulties associated with venting air from coolant channels during coolant refill. Thus, there presently exists a need in the art for a more reliable system and a faster process for venting trapped air from a coolant system during a coolant refill procedure. Accordingly, the disclosed venting assembly and process is directed at overcoming one or more of these disadvantages in currently available plugs and seals for engine coolant systems.

SUMMARY

In accordance with one aspect of the disclosure, a venting plug assembly for sealing a coolant channel and venting air therefrom is disclosed. The coolant channel defines an open portion to receive the venting plug assembly. The venting plug assembly includes an outer sealing element having an annular portion configured for sealing engagement with the open portion of the coolant channel. The venting assembly further includes an inner sealing element configured for sealing engagement with the annular portion of the outer sealing element. The inner sealing element is configured to move relative to the annular portion of the outer sealing element to allow air to vent from the coolant channel through the outer sealing element.

In accordance with another aspect of the disclosure, a process for installing a venting plug assembly in a coolant channel defining an open portion to receive the venting plug assembly is disclosed. The process includes providing an outer sealing element having an annular portion and sealing the outer sealing element within the open portion of the coolant channel. The process further includes providing an inner sealing element and sealing the inner sealing element within the annular portion of the outer sealing element. The inner sealing element is configured to move relative to the annular portion of the outer sealing element to allow air to vent from the coolant channel through the outer sealing element.

In accordance with another aspect of the disclosure, an engine is disclosed. The engine includes an engine block having a plurality of cylinders, a coolant channel defining an open portion to receive a venting plug assembly for sealing the coolant channel and venting air therefrom in the engine. The venting plug assembly includes an outer sealing element having an annular portion sealed within the open portion of the coolant channel and an inner sealing element sealed within the annular portion of the outer sealing element. The inner sealing element is configured to move relative to the annular portion of the outer sealing element to allow air to vent from the coolant channel through the outer sealing element.

BRIEF DESCRIPTION OF THE DRAWINGS

The above-mentioned and other features and advantages of this disclosure, and the manner of attaining them, will become apparent and be better understood by reference to the following description of one aspect of the disclosure in conjunction with the accompanying drawings, wherein.

DETAILED DESCRIPTION

Figure 1:
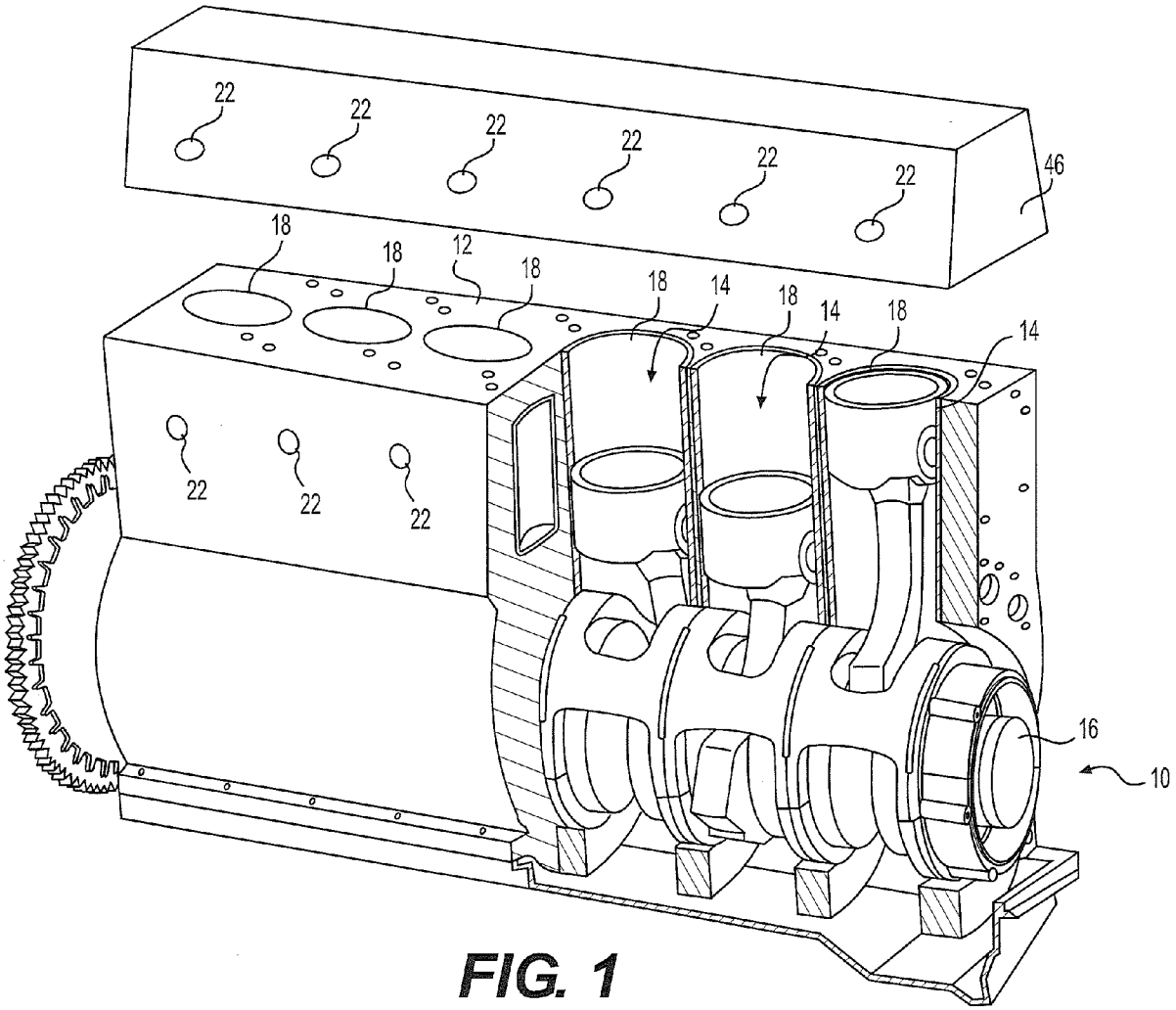
FIG. 1 is a cut-away perspective view of an internal combustion engine, according to an aspect of the disclosure.

An internal combustion engine 10 according to an aspect of the disclosure is illustrated in FIG. 1. The internal combustion engine 10 is depicted and described as a diesel engine. However, it is contemplated that the internal combustion engine 10 may be any type of reciprocating internal combustion engine 10, such as, for example, a compression ignition engine, a spark ignition engine, combinations thereof, or any other reciprocating internal combustion engine 10 known in the art. The internal combustion engine 10 may include an engine block 12, a plurality of piston assemblies 14 pivotally connected to a crankshaft 16, and a plurality of cylinders 18.

The engine block 12 may be a central structural member defining the plurality of cylinders 18. Alternatively, the cylinders 18 may be defined by cylinder liners inserted into the block 12. One of piston assemblies 14 may be slidably disposed within each of cylinders 18. It is contemplated that internal combustion engine 10 may include any number of cylinders 18 and that the cylinders 18 may be disposed in an "in-line" configuration, a "V" configuration, or any other configuration known in the art.

Figure 2:
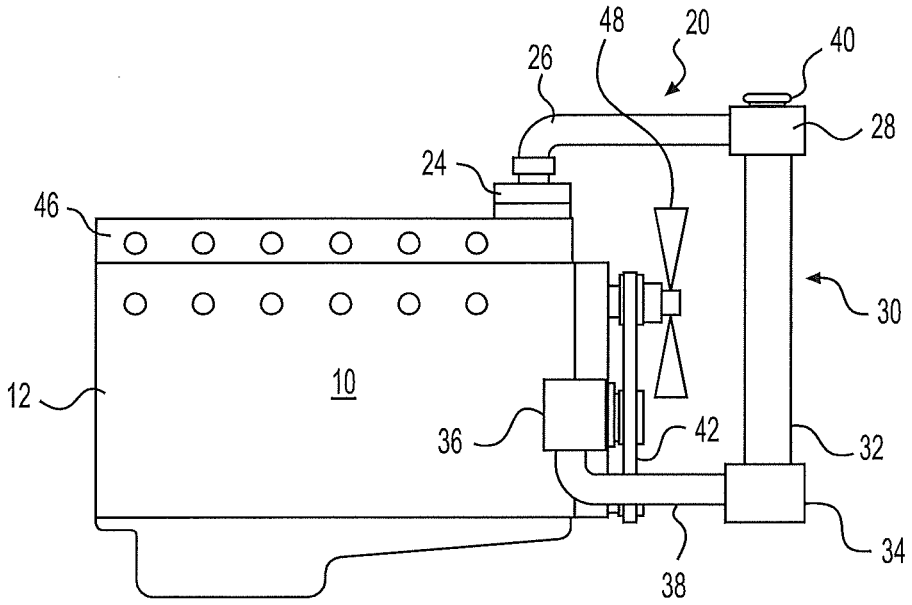
FIG. 2 is a schematic illustration of an engine cooling system, according to an aspect of the disclosure.

Referring to FIG. 2, there is shown schematically an engine cooling system 20 for cooling an engine 10. The cooling system 20 may include a thermostat housing 24 communicating by way of a pipe or hose 26 with a top tank 28 of a radiator 30 having radiator core 32. A bottom tank 34 of the radiator 30 communicates with a pump 36 associated with the engine 10 by way of a pipe or hose 38.

The cooling system 20 may be filled or refilled through a cap aperture of a filling neck 40 on the top tank 28, and the coolant flows down through the core 32 to the bottom tank 34. The pump 36 may be driven by the engine 10, such as by a fan belt 42, to pump the coolant into coolant channels 22 (shown in FIG. 3) within the engine block 12 and cylinder head 46 of the engine 10 where the coolant absorbs heat generated by the engine 10. The coolant then may flow through thermostat assembly 24 to the top tank 28 and down through radiator core 32 where it is cooled by air flow through the core 32 assisted by fan 48.

It will be understood by those skilled in the art that engine 10 may include numerous other engine systems, controls, and the like, not shown in FIG. 2, which is merely a schematic illustration of the cooling system 20 of the engine 10 helpful for understanding the disclosure.

Figure 3:
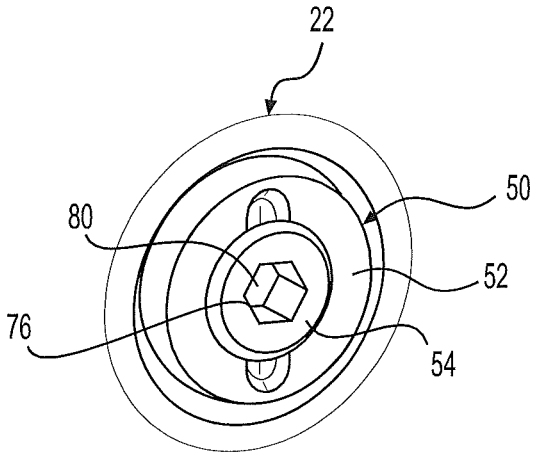
FIG. 3 is a front perspective view of a venting plug assembly installed within a coolant channel of an engine, according to an aspect of the disclosure.
Figure 4:
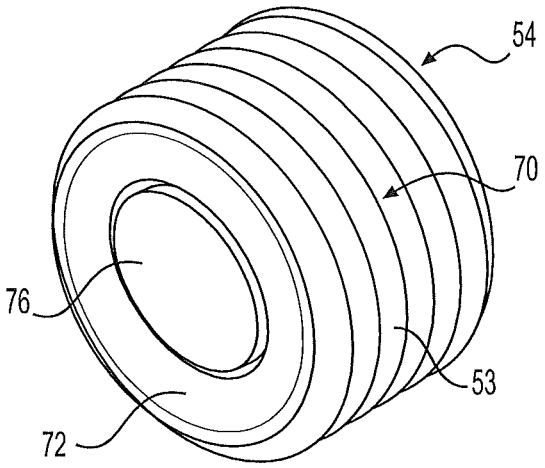
FIG. 4 is a rear perspective view of an inner sealing element of the venting plug assembly shown in FIG. 3, according to an aspect of the disclosure.
Figure 5:
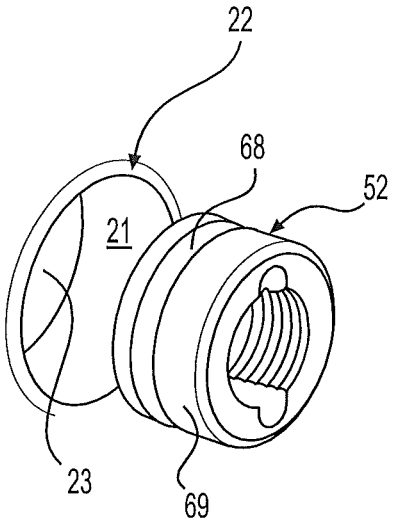
FIG. 5 is a perspective view of an outer sealing element of the venting plug assembly shown in FIG. 3 separated from the coolant channel, according to an aspect of the disclosure.

Referring now to FIG. 3, a front perspective view of a venting plug assembly 50 installed within a coolant channel 22 is shown. As shown, the venting plug assembly 50 may include an outer sealing element 52 and an inner sealing element 54 according to an aspect of the disclosure. The inner sealing element 54 of the venting plug assembly 50 is shown in FIG. 4. FIG. 5 illustrates a perspective view of the outer sealing element 52 of the venting plug assembly 50 separated from the coolant channel 22.

The venting plug assembly 50 may be used to seal a coolant channel 22 in an engine 10, a compressor, or any other machine or system having a coolant channel known in the art. The venting plug assembly 50 may also serve to vent air from the coolant channel 22 through the outer sealing element 52 as described in further detail below. In some aspects of the present disclosure, the venting plug assembly 50 may be used to replace used or worn freeze plugs. Alternatively, the venting plug assembly 50 may be installed as original equipment for the engine 10.

The venting plug assembly 50 may be made of cast metals, such as iron, steel, aluminum, or any other material suitable for the application. In some aspects, the venting plug assembly 50 may be coated with corrosion resistant materials to prolong the life of the venting plug assembly 50.

The coolant channel 22 may have an open portion 23 and sidewalls 21. The open portion 23 of the coolant channel 22 may be a hole formed during the manufacturing process. Generally, an engine 10 may have a plurality of coolant channels 22 and therefore, may have a plurality of venting plug assemblies 50. In some aspects of the present disclosure, the venting plug assembly 50 may be used to seal coolant channels 22 located in the engine block 12 or the cylinder head 46 of the engine 10.

The outer sealing element 52 is configured to be sealed within the open portion 23 of the coolant channel 22. In some aspects of the present disclosure, a seal may be formed between the exterior surface 69 of the outer sealing element 52 and the open portion 23 of the coolant channel 22. There may be no need to remove the outer sealing element 52 from the coolant channel 22 for routine maintenance or to refill the engine 10 with coolant because venting occurs from the coolant channel 22 through the outer sealing element 52.

The outer sealing element 52 may be sealed within the open portion 23 of the coolant channel 22 using any suitable means known in the art. For example, a weld, a sealant material, or an adhesive may be used to produce a seal between the open portion 23 of the coolant channel 22 and the outer sealing element 52.

Figure 6:
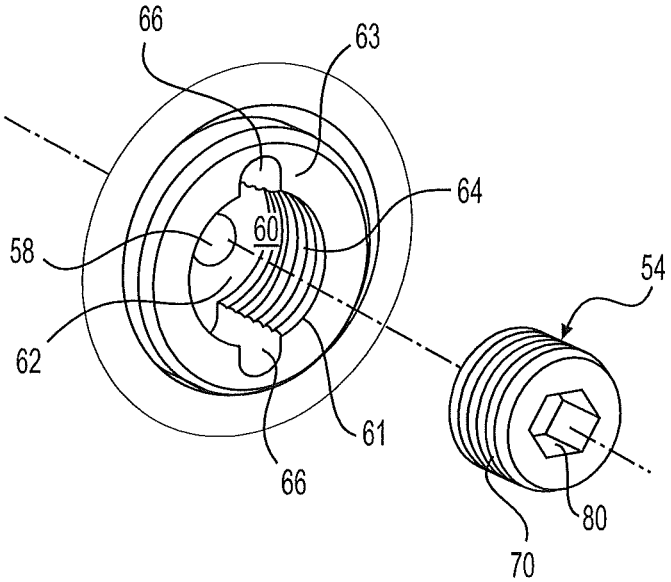
FIG. 6 is an exploded perspective view of the venting plug assembly showing the outer sealing element separated from the inner sealing element, according to an aspect of the disclosure.

Referring now to FIG. 6, the outer sealing element 52, sealed within the open portion 23 of the coolant channel 22, is illustrated. The inner sealing element 54 is separated from the outer sealing element 52 to illustrate certain features of the outer sealing element 52. According to some aspects of the disclosure, the outer sealing element 52 may be pressed within the coolant channel 22 with sufficient force to create a press fit between the outer sealing element 52 and the coolant channel 22. According to other aspects of the present disclosure, the outer sealing element 52 may be inserted within the coolant channel 22 with a force directed substantially axially relative to the coolant channel 22. The outer sealing element 52 may be pressed within the coolant channel 22 manually. A tool may also be used to fit the outer sealing element 52 within the coolant channel 22.

Figure 7:
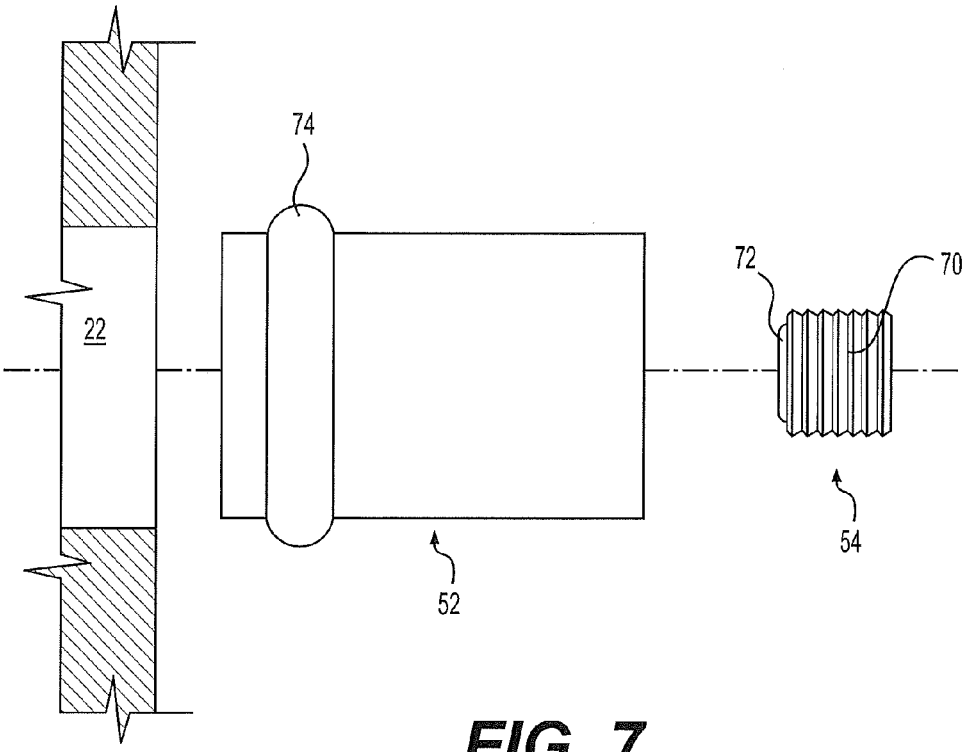
FIG. 7 is an exploded side view of the venting plug assembly showing the outer sealing element and the inner sealing element, according to an aspect of the disclosure.
Figure 8:
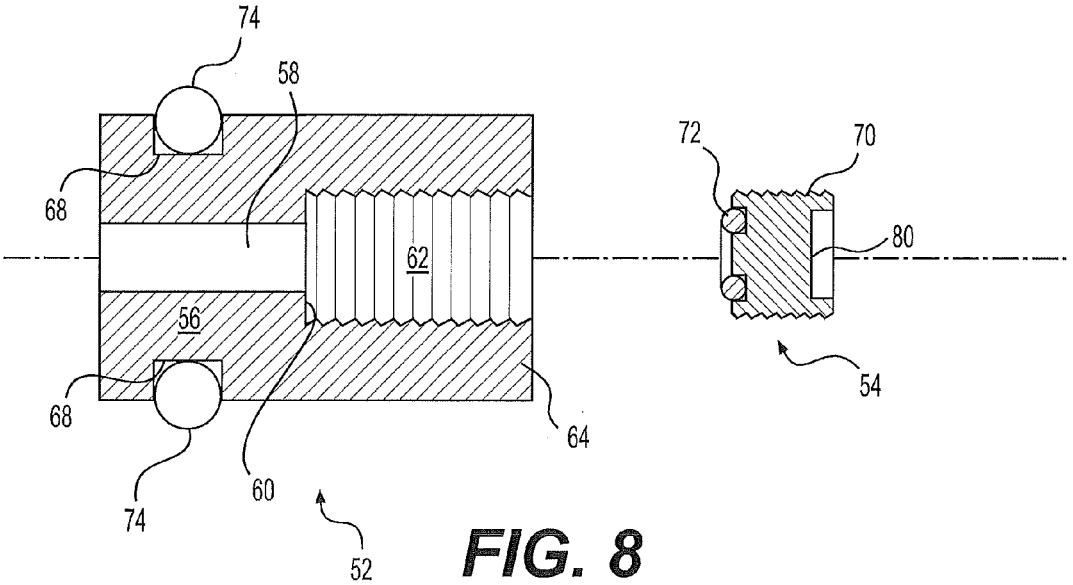
FIG. 8 is an exploded cross-sectional view of a venting plug assembly along the section line VIII-VIII shown in FIG. 9, according to an aspect of the disclosure.

Referring now to FIGS. 7 and 8, the venting plug assembly 50 is shown, according to an aspect of the disclosure. In FIG. 7, an exploded side view of the venting plug assembly 50 is illustrated. In FIG. 8, an exploded cross-sectional view of a venting plug assembly 50 is illustrated. As shown in FIGS. 7 and 8, the outer sealing element 52 may have a groove 68 disposed around the exterior surface 69 of the outer sealing element 52. The groove 68 may be configured to accommodate an O-ring 74 or other similar seal known in the art. The O-ring 74 resides in the groove 68 and becomes compressed when the outer sealing element 52 is secured within the coolant channel 22. The O-ring 74 forms a seal between the outer sealing element 52 and the open portion 23 of the coolant channel 22. Other mechanical seals or gaskets may be used, however, to form a seal between the outer sealing element 52 and the open portion 23 of the coolant channel 22. The O-ring 74, a similar seal, or a gasket may be composed of a heat resistant elastomeric material that is suitable to provide efficient sealing in engine parts.

In some aspects of the present disclosure, the outer sealing element 52 may include a base portion 56. The base portion 56 may define an aperture 58 (shown in FIG. 8) that extends through the base portion 56 along the longitudinal axis of the outer sealing element 52. The aperture 58 may be sized appropriately for allowing air to flow through. Air may for example, vent from the coolant channel 22 through the aperture 58 of the outer sealing element 52.

The outer sealing element 52 may also include a planar base surface 60. The planar base surface 60 may extend perpendicular to the longitudinal axis of the outer diameter of the aperture 58 to define an annular portion 62. The annular portion 62 of the outer sealing element 52 is generally configured to accommodate the inner sealing element 54. The relationship between the annular portion 62 and the inner sealing element 54 is illustrated in FIGS. 6-8. According to an aspect of the disclosure, the annular portion 62 may have cylindrical sidewalls 63 that extend from the planar base surface 60 in a direction away from the base portion 56 of the outer sealing element 52. In one aspect of the disclosure, the cylindrical sidewalls 63 may be perpendicular to the planar base surface 60.

The overall dimensions of the outer sealing element 52 may generally depend on the dimensions of the coolant channel 22. A larger coolant channel 22, for example, may require a larger outer sealing element 52. Smaller coolant channels 22 may require smaller outer sealing elements 52. In some aspects of the present disclosure, the outer sealing element 52 may be cylindrical in shape and the annular portion 62 of the outer sealing element 52 may have a uniform circular cross-section.

Figure 9:
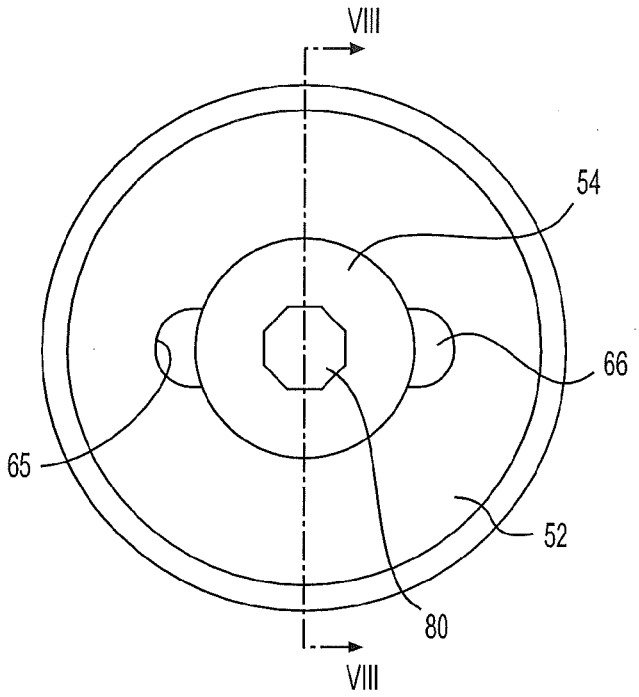
FIG. 9 is a front view of the venting plug assembly shown in FIG. 3, according to an aspect of the disclosure.
Figure 10:
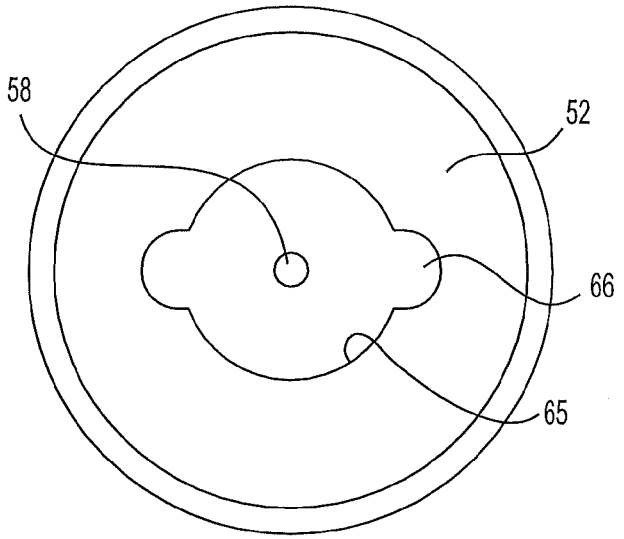
FIG. 10 is a front view of the outer sealing element shown in FIG. 9 without the inner sealing element, according to an aspect of the disclosure.

In some aspects of the disclosure, the outer sealing element 52 of the venting plug assembly 50 may include at least one recessed portion 66. Recessed portions 66 are shown in FIGS. 9 and 10. FIG. 9 illustrates a front view of the venting plug assembly 50. FIG. 10 illustrates a front view of the outer sealing element 52 without the inner sealing element 54. As shown, the outer sealing element 52 may include two recessed portions 66 situated 180 degrees apart from each other. Additional recessed portions 66, however, may be present on the outer sealing element 52.

The recessed portions 66 may be defined by the interior surface 65 of the cylindrical sidewalls 63 of the annular portion 62 of the outer sealing element 52. The recessed portions 66 may extend along the longitudinal axis of the outer sealing element 52. In some aspects of the disclosure, the recessed portion 66 may traverse the inner threaded portion 64 of the outer sealing element 52 and extend along the longitudinal axis of the outer sealing element 52.

The recessed portions 66 may provide additional pathways for air to vent from the coolant channel 22. For example, air may travel from the coolant channel 22 through the aperture 58 as described above and through the recessed portions 66. Faster coolant refilling and efficient venting may be achieved in part by the presence of recessed portions 66 on the outer sealing element 52.

Figure 11:
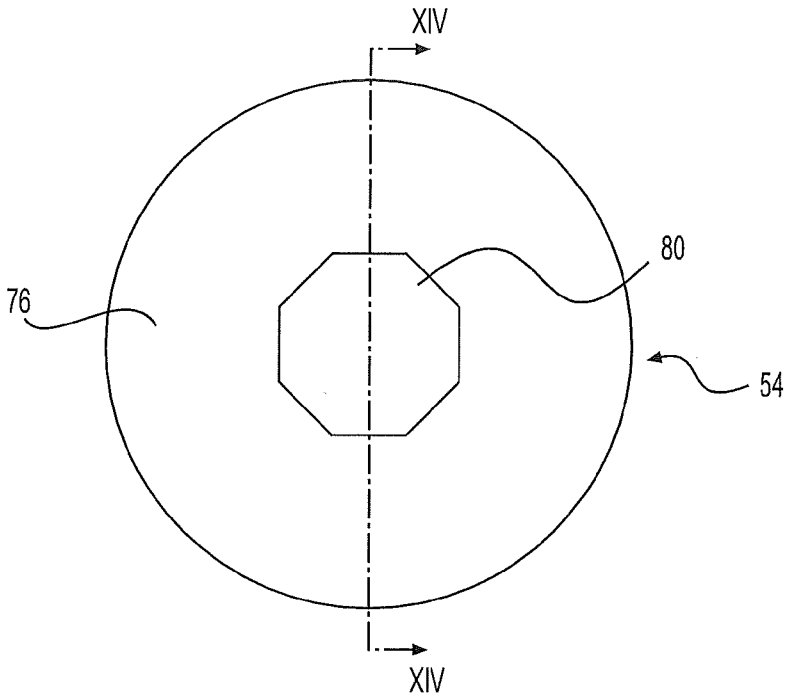
FIG. 11 is a front view of the inner sealing element shown in FIG. 3, according to an aspect of the disclosure.
Figure 12:
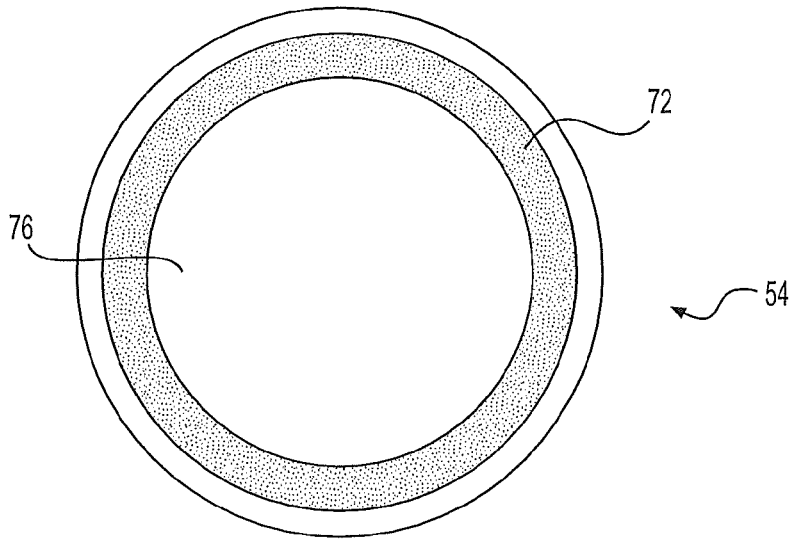
FIG. 12 is a back view of the inner sealing element shown in FIG. 3, according to an aspect of the disclosure.

FIGS. 11-14 illustrate the inner sealing element 54 according to an aspect of the disclosure. In particular, FIG. 11 illustrates a front view of the inner sealing element 54 and FIG. 12 illustrates a back view of the inner sealing element 54. According to an aspect of the disclosure, the inner sealing element 54 may have a cylindrical body. The inner sealing element 54, however, may be any shape provided that the inner sealing element 54 is configured to be sealed within the annular portion 62 of the outer sealing element 52. For example, the inner sealing element 54 may fit inside the annular portion 62 such that a seal is created between the inner sealing element 54 and the planar base surface 60.

The inner sealing element 54 is configured to move with respect to the outer sealing element 52 to allow air to vent from the coolant channel 22 through the outer sealing element 52. The movement of the inner sealing element 54 with respect to the outer sealing element 52 may unseal the inner sealing element 54 from the annular portion 62 of the outer sealing element 52 such that air may vent through the outer sealing element 52. The inner sealing element 54 may be loosened or partially removed from the outer sealing element 52 to allow venting to occur without completely removing the inner sealing element 54. The inner sealing element 54 may also be completely removed from the outer sealing element 52 to allow venting to occur. It may, however, be faster and more efficient to loosen the inner sealing element 54 from the outer sealing element 52 enough to allow venting to occur without completely removing the inner sealing element 54 from the annular portion 62.

In one aspect of the disclosure, the annular portion 62 of the outer sealing element 52 may include an inner threaded portion 64. The inner threaded portion 64 may be disposed along the interior surface 61 of the annular portion 62. The inner threaded portion 64 may be disposed along the interior surface 65 of the cylindrical sidewalls 63 of the annular portion 62. The inner threaded portion 64 may be configured to mate with the outer threaded portion 70. The inner threaded portion 64 and the outer threaded portion 70 may enable the inner sealing element 54 to move with respect to the annular portion 62 to allow air to vent from the coolant channel 22 through the outer sealing element 52. For example, when the inner threaded portion 64 and the outer threaded portion 70 are mated together and rotated in one direction, the inner sealing element 54 may be tightly engaged with or sealed to the annular portion 62 of the outer sealing element 52. Rotation in the opposite direction may loosen or remove the inner sealing element 54 from the annular portion 62.

During an engine 10 coolant refill, the inner sealing element 54 may be rotated in one direction to loosen the inner sealing element 54 from the annular portion 62 of the outer sealing element 52 to allow venting to occur. The rotation of the inner sealing element 54 with respect to the annular portion 62 of the outer sealing element 52 may be adjusted to allow for more or less venting from the coolant channel 22 through the outer sealing element 52. Once venting is no longer needed and/or the coolant refill is complete, the inner sealing element 54 may be resealed within the annular portion 62 of the outer sealing element 52 by rotating the inner sealing element 54 in an opposite direction.

Figure 13:
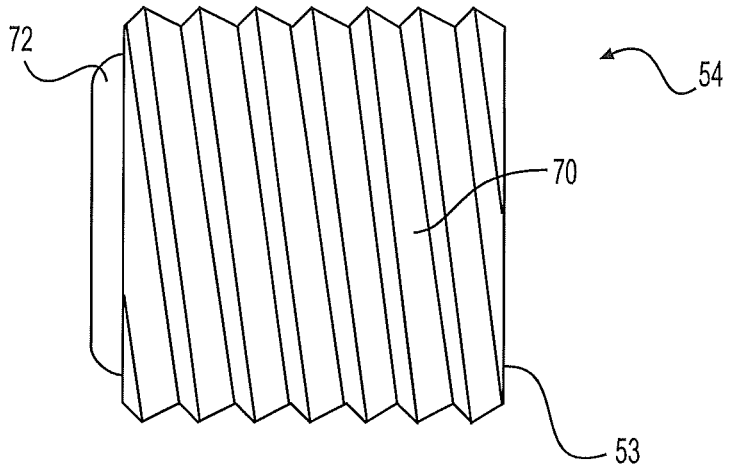
FIG. 13 is a side view of the inner sealing element shown in FIG. 3, according to an aspect of the disclosure.
Figure 14:
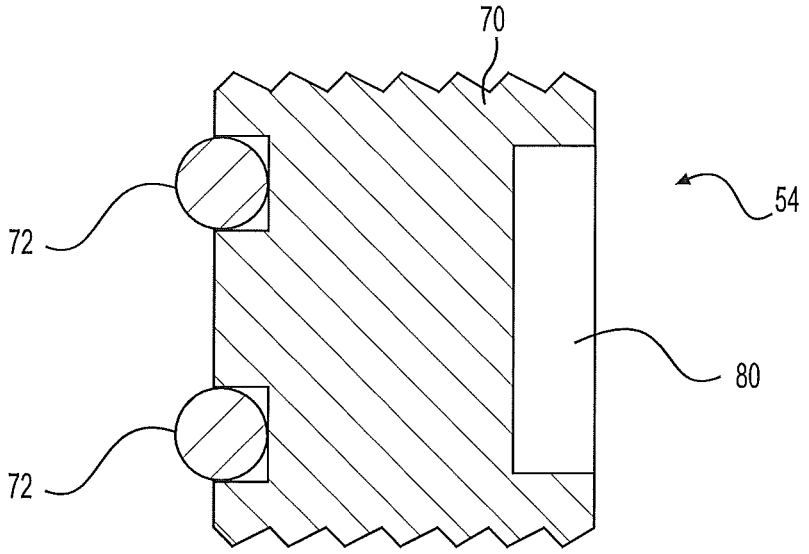
FIG. 14 is a cross-sectional view of an inner sealing element along the section line XIV-XIV shown in FIG. 11, according to an aspect of the disclosure.

Referring now to FIGS. 13 and 14, there is an inner sealing element 54 according to an aspect of the disclosure. In particular, FIG. 13 illustrates a side view of the inner sealing element 54 and FIG. 14 illustrates a partial cross-section view of the inner sealing element 54. As shown in FIGS. 13 and 14, an O-ring face seal 72 may be mounted on the inner sealing element 54. The O-ring face seal 72 may form a seal between the distal end 76 of the inner sealing element 54 and the planar base surface 60 of the outer sealing element 52. Other types of mechanical seals and gaskets may also be used to form a seal between the inner sealing element 54 and the planar base surface 60 of the outer sealing element 52.

Installation of the inner sealing element 54 to the annular portion 62 and/or removal of the inner sealing element 54 from the annular portion 62 may be performed manually in some aspects of the disclosure. Alternatively, a socket 80 may be formed on a distal end 76 of the inner sealing element 54 that is proximate to the open portion 23 of the coolant channel 22. The socket 80 may be configured to receive a tool that engages the socket 80 and transmits a circumferential or rotating force to tighten or loosen the inner sealing element 54 from the annular portion 62.

The venting plug assembly 50 may be installed in the coolant channel 22 of an engine 10 by providing an outer sealing element 52 having an annular portion 62 and sealing the outer sealing element 52 within the open portion 23 of the coolant channel 22. The installation may also include providing an inner sealing element 54 and sealing the inner sealing element 54 within the annular portion 62 of the outer sealing element 52. The inner sealing element 54 may be configured to move with respect to the annular portion 62 of the outer sealing element 52 to allow air to vent from the coolant channel 22.

Sealing the outer sealing element 52 within the open portion 23 of the coolant channel 22 includes forming a seal between the exterior surface 69 of the outer sealing element 52 and the sidewalls 21 of the coolant channel 22. The outer sealing element 52 may be sealed within the open portion 23 of the coolant channel 22 by manually pressing the outer sealing element 52 into the open portion 23 of the coolant channel 22. A sealant material or adhesive may be used to seal the outer sealing element 52 into the open portion 23 of the coolant channel 22.

Sealing the inner sealing element 54 within the annular portion 62 of the outer sealing element 52 includes forming a seal between the inner sealing element 54 and the planar base surface 60 of the annular portion 62. The inner sealing element 54 may be sealed to the annular portion 62 of the outer sealing element 52 by providing an inner threaded portion 64 on the interior surface 61 of the annular portion 62 of the outer sealing element 52, an outer threaded portion 70 on the exterior surface 53 of the inner sealing element 54 and mating the inner threaded portion 64 and the outer threaded portion 70 together.

In some aspects according to the disclosure, installing a venting plug assembly 50 may include removing a used or worn freeze plug from the coolant channel 22 prior to sealing the outer sealing element 52 within the open portion 23 of the coolant channel 22. In other aspects of the disclosure, air may be vented from the coolant channel 22 prior to sealing the inner sealing element 54 within the annular portion 62 of the outer sealing element 52. The engine's cooling system 20 may be filled with coolant prior to sealing the inner sealing element 54.

INDUSTRIAL APPLICABILITY

The disclosure may find applicability for venting a cooling system 20 after refilling the cooling system 20 of a wide range of internal combustion engines 10 with coolant. For example, this process may be utilized in any engine 10 or machine that has a cooling system 20. The process may be utilized, for example, in any engine 10 or machine that performs some type of operation associated with industry such as mining, construction, farming, transportation, or any other industry known in the art.

The process disclosed herein may be used in applications such as motor vehicles, machines, locomotives, marine engines, electrical power generators, small mechanical engines, work implements, pumps, etc. The venting plug assembly 50 may be used as original equipment manufactured as part of a new engine 10 or the venting plug assembly 50 may be installed as a replacement part to replace worn freeze plugs. The process may for example be used to remanufacture a used or worn cylinder head 46 in an engine 10 or an engine block 12. Part of the remanufacturing process may include removal of a worn freeze plug to expose the coolant channel 22 and installation of the venting plug assembly 50.

During a coolant refill, spent coolant is removed from the engine's cooling system 20. The coolant may be removed by any suitable means. Once the spent coolant has been removed, new coolant is be added to the engine's cooling system 20. While the new coolant is being added, the inner sealing element 54 may be removed from the annular portion 62 of the outer sealing element 52 to vent air from the coolant channels 22. This venting may also occur by partially removing or loosening the inner sealing element 54.

The venting plug assembly 50 will allow coolant refill to occur more rapidly while ensuring that any air present in the coolant channels 22 is properly vented, thereby reducing the risk of damage to the engine block 12 and cylinder head 46. Additionally, the disclosed venting plug assembly 50 and process may lead to more efficiently operating machines and engines 10 because the coolant in the cooling system 20 for the engine 10 can be replaced more efficiently. This will ultimately improve the reliability of the engine 10 overall because changing the coolant in the engine 10 may be an important part of the regular maintenance of the engine 10.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

We claim:

1. A venting plug assembly for sealing a coolant channel and venting air therefrom, the coolant channel defining an open portion to receive the venting plug assembly, the venting plug assembly comprising:

an outer sealing element having an annular portion configured for sealing engagement with the open portion of the coolant channel;

an inner sealing element configured for sealing engagement with the annular portion of the outer sealing element, wherein the inner sealing element is configured to move relative to the annular portion of the outer sealing element to allow air to vent from the coolant channel through the outer sealing element;

the outer sealing element further including a base portion defining an aperture extending through the base portion along a longitudinal axis of the outer sealing element, and the annular portion including an interior surface having at least one recessed portion formed therein and extending along the longitudinal axis of the outer sealing element for the venting of air through the outer sealing element; and a face seal located axially between the inner sealing element and the outer sealing element, wherein the inner sealing element is positioned at a first location relative to the annular portion of the outer sealing element where the face seal blocks fluid communication between the aperture and the at least one recessed portion to block the venting of air from the coolant channel, and is movable to a second location relative to the annular portion of the outer sealing element where the face seal does not block fluid communication between the aperture and the at least one recessed portion to allow the venting of air from the coolant channel.

2. The venting plug assembly of claim 1, further comprising an inner threaded portion disposed on the interior surface of the annular portion, and an outer threaded portion disposed on an exterior surface of the inner sealing element, wherein the inner threaded portion and the outer threaded portion are configured to mate together.

3. The venting plug assembly of claim 1, wherein the coolant channel is located in an engine block or a cylinder head of an engine.

4. The venting plug assembly of claim 1, wherein the outer sealing element comprises:

a planar base surface extending perpendicular to the longitudinal axis from an outer diameter of the aperture, wherein the annular portion of the outer sealing element is defined by cylindrical sidewalls extending from the planar base surface away from the base portion.

5. The venting plug assembly of claim 4, wherein the cylindrical sidewalls are perpendicular to the planar base surface.

6. The venting plug assembly of claim 4, further comprising an inner threaded portion disposed on an interior surface of the cylindrical sidewalls of the annular portion and an outer threaded portion being disposed on an exterior surface of the inner sealing element, wherein the inner threaded portion and the outer threaded portion are configured to mate together.

7. The venting plug assembly of claim 4 wherein the face seal includes an O-ring face seal mounted onto the inner sealing element, the O-ring face seal being configured to provide a seal between a distal end of the inner sealing element and the planar base surface of the outer sealing element.

8. The venting plug assembly of claim 4 wherein the at least one recessed portion is formed in the interior surface of the cylindrical sidewalls of the annular portion.

9. The venting plug assembly of claim 4, further comprising a groove disposed around an exterior surface of the outer sealing element and an O-ring within the groove configured to provide a seal between the exterior surface of the outer sealing element and sidewalls of the coolant channel.

10. The venting plug assembly of claim 4, further comprising a socket formed on a distal end of the inner sealing element proximate to the open portion of the coolant channel, wherein the socket is configured to receive a tool to engage and disengage the inner sealing element from the annular portion of the outer sealing element.

11. A process for installing a venting plug assembly in a coolant channel, the coolant channel defining an open portion to receive the venting plug assembly, the process comprising:

providing an outer sealing element, the outer sealing element having a base portion defining an aperture extending through the base portion along a longitudinal axis of the outer sealing element and an annular portion including an interior surface having at least one recessed portion formed therein and extending along the longitudinal axis of the outer sealing element for the venting of air through the outer sealing element;

sealing the outer sealing element within the open portion of the coolant channel;

providing an inner sealing element; and sealing the inner sealing element within the annular portion of the outer sealing element at least in part by forming a face seal axially between the inner sealing element and the outer sealing element, wherein the inner sealing element is configured to move relative to the annular portion of the outer sealing element from a first location where the face seal blocks fluid communication between the aperture and the at least one recessed portion to block the venting of air from the coolant channel, to a second location where the face seal does not block fluid communication between the aperture and the at least one recessed portion to allow air to vent from the coolant channel through the outer sealing element.

12. The process of claim 11, wherein the sealing the outer sealing element further includes manually pressing the outer sealing element into the open portion of the coolant channel.

13. The process of claim 11, wherein the sealing the outer sealing element further includes using a sealant material or an adhesive to fix the outer sealing element within the open portion of the coolant channel.

14. The process of claim 13, wherein the sealing the inner sealing element further comprises:

providing an inner threaded portion on the interior surface of the annular portion;

providing an outer threaded portion on an exterior surface of the inner sealing element; and mating the inner threaded portion and the outer threaded portion.

15. The process of claim 13, wherein the sealing the outer sealing element within the open portion of the coolant channel further includes forming a seal between an exterior surface of the outer sealing element and sidewalls of the coolant channel.

16. The process of claim 13, wherein the providing the outer sealing element further includes providing a base portion including a planar base surface extending perpendicular to the longitudinal axis from an outer diameter of the aperture, wherein the annular portion of the outer sealing element is defined by cylindrical sidewalls extending from the planar base surface away from the base portion.

17. The process of claim 16, wherein the sealing the inner sealing element further includes forming the face seal between the inner sealing element and the planar base surface of the outer sealing element.

18. The process of claim 13, further comprising removing a freeze plug from the coolant channel prior to the sealing the outer sealing element within the coolant channel.

19. The process of claim 13, further comprising filling the coolant channel with coolant prior to the sealing the inner sealing element.

20. An engine comprising:

an engine block having a plurality of cylinders, a coolant channel defining an open portion to receive a venting plug assembly for sealing the coolant channel and venting air therefrom in the engine, wherein the venting plug assembly comprises:

an outer sealing element having an annular portion sealed within the open portion of the coolant channel; and an inner sealing element sealed within the annular portion of the outer sealing element, wherein the inner sealing element is configured to move relative to the annular portion of the outer sealing element to allow air to vent from the coolant channel through the outer sealing element;

the outer sealing element further including a base portion defining an aperture extending through the base portion along a longitudinal axis of the outer sealing element, and the annular portion including an interior surface having at least one recessed portion formed therein and extending along the longitudinal axis of the outer sealing element for the venting of air through the outer sealing element;

a face seal located axially between the inner sealing element and the outer sealing element, wherein the inner sealing element is positioned at a first location relative to the annular portion of the outer sealing element where the face seal blocks fluid communication between the aperture and the at least one recessed portion to block the venting of air from the coolant channel, and is movable to a second location relative to the annular portion of the outer sealing element where the face seal does not block fluid communication between the aperture and the at least one recessed portion to allow the venting of air from the coolant channel.

* * * * *